United States Patent [19]

Leland

[11] Patent Number: 4,925,486

[45] Date of Patent: May 15, 1990

[54] HIGHLY COMPACTABLE ZIRCONIUM SPONGE AND ITS MANUFACTURE

[75] Inventor: John D. Leland, Corvallis, Oreg.

[73] Assignee: Teledyne Industries, Inc., Albany, Oreg.

[21] Appl. No.: 391,028

[22] Filed: Aug. 9, 1989

[51] Int. Cl.[5] ..... B22F 9/00

[52] U.S. Cl. ..... 75/360; 241/23

[58] Field of Search ..... 75/0.5 BB, 0.5 R, 84; 241/17, 23; 423/645

[56] References Cited

U.S. PATENT DOCUMENTS 2,829,962 3/1955 Supiro ..... 75/0.5 BB
4,655,825 4/1987 Hard et al. ..... 75/0.5 B

FOREIGN PATENT DOCUMENTS 1196376 4/1964 Fed. Rep. of Germany .
3143209 6/1988 Japan .

*Primary Examiner*—John P. Sheehan
*Assistant Examiner*—David W. Schumaker
*Attorney, Agent, or Firm*—Shoemaker & Mattare, Ltd.

[57] ABSTRACT

The process for producing crushed zirconium sponge having particle configurations which enhance its compactability, wherein conventionally produced, as-reduced, non-sintered zirconium sponge pieces are loaded into a vacuum furnace, the furnace is heated under partial vacuum at a temperature of up to about 400° C. for a sufficient period to essentially demoisturize and degas the sponge, the temperature is raised to at least about 700° C. and the vacuum terminated, $H_2$ is fed in a carefully controlled manner into the furnace over a period of several hours in a total amount comprising from about 0.05 to about 0.8% by weight of the sponge, the furnace is cooled, the cooled sponge is pacified, the sponge is removed from the furnace and crushed, the crushed sponge is loaded into a vacuum furnace, the furnace is heated at from about 950° C. to about 1100° C. under partial vacuum for a sufficient period to dehydride the sponge, and the dehydrided sponge, now of enhanced compactability, is cooled and recovered.

6 Claims, No Drawings

HIGHLY COMPACTABLE ZIRCONIUM SPONGE AND ITS MANUFACTURE

BACKGROUND OF THE INVENTION

This invention relates to highly compactable zirconium sponge which has previously been crushed, wherein prior to crushing, the sponge has been specially treated to give, upon crushing, a modified particle configuration which lends to subsequent compacted articles of improved physical properties.

Conventional, as-reduced, zirconium sponge is occasionally broken up by crushing into small particle sizes and used to make compacted parts according to conventional powder metallurgy practices. Zirconium sponge, however, is not an easily crushed material as it tends to deform plastically rather than fracture. This characteristic results in material which is not readily compacted to dimensional shapes, since some of the sponge particles have in essence been pre-compacted during the crushing.

It is known that metal hydrides, typically of the formula $MH_2$, wherein M is a metal capable of reacting with hydrogen, are characteristically brittle. This characteristic lends to the manufacture of particulate metals. For example, a piece of metal may be heated and exposed to hydrogen gas for a period of several hours, after which the metal becomes substantially hydrided. Typically, by such processing the metal absorbs about one to about three or more percent by weight of hydrogen, and becomes brittle and more easily comminuted to powdered form. In U.S. Pat. No. 4,300,949, the disclosure of which is incorporated by reference, a method is disclosed whereby metal is heated in the presence of hydrogen while concurrently being subjected to mechanical impact to obtain a particulate hydride of average particle size of less than about one centimeter. Plasma generators, such as disclosed in U.S. Patent Nos. 3,803,403; 3,843,352; 3,848,068; and 4,655,825, have been used in various contexts in connection with the preparation or treatment of reactive metal hydrides. The process of U.S. Pat. No. 3,803,403 utilizes a plasma arc to generate spherical, non-friable particles which can be fabricated into an article for use as a hydrogen storage device. U.S. Pat. No. 3,843,352 utilizes a gas plasma in a cooled metal crucible to melt sponge metal. U.S. Pat. No. 3,848,068 vaporizes metal powder with a plasma and rapidly quenches the vapor to obtain ultra pure finely divided metal compounds, such as metal hydride. The plasma gas may contain up to 100 percent hydrogen.

As described in U.S. Pat. No. 4,728,507, metal hydrides, for example, zirconium alloy hydrides, are produced by introducing the metal to a melting zone under conditions which form individual droplets of the metal. These droplets are exposed to a hydrogen atmosphere as they are cooled to a temperature which promotes the desired degree of hydrogen absorption, e.g., 0.5–1.0% by weight, which renders the droplets friable for use in powder metallurgy. The U.S. Pat. No. 4,655,825 patent suggests the complete hydriding of metal sponge obtained directly from a conventional zinc alloying and distillation process, and its subsequent comminution for use in powder metallurgy.

These patents are concerned, in varying degrees, with the hydriding of metal or sponge of the Group IV-b and V-b metals, however, those efforts appear to have been of a general nature and not contemplative of the particular problems associated with producing from "as-reduced" zirconium, a powder of exceptionally high compactability for use in powder metallurgy.

A principal object, therefore, of the present invention is to provide a non-complex process for preparing highly compactable, crushed zirconium from "as-reduced" sponge using essentially conventional vacuum furnace equipment, in a highly efficient and economical manner.

SUMMARY OF THE INVENTION

The foregoing, and other objects hereinafter appearing, have been attained in accordance with the present invention through the discovery defined as the process for producing crushed zirconium sponge having particle configurations which enhance its compactability, comprising the steps of:

(a) loading as-reduced, non-sintered zirconium sponge pieces into a vacuum furnace;
(b) heating said sponge under partial vacuum at a temperature of up to about 400° C. for a sufficient period to essentially demoisturize and degas the sponge;
(c) raising the temperature to between about 700° C. and 750° C. and terminating the vacuum;
(d) feeding H2 slowly into the furnace over a predetermined period of time in a total amount of from about 0.05 to about 0.8% by weight of the sponge;
(e) cooling the furnace;
(f) pacifying the cooled sponge;
(g) removing the cooled sponge from the furnace and crushing it;
(h) loading the crushed sponge into a vacuum furnace;
(i) heating the crushed sponge at from about 950° C. to about 1100° C. under partial vacuum for a sufficient period to dehydride the crushed sponge; and
(j) cooling and recovering the dehydrided crushed sponge, in a form which is capable of exhibiting enhanced compactability.

In certain preferred embodiments:

(1) the $H_2$ in (d) is metered to the furnace and comprises from about 0.2 to about 0.4 weight of the sponge;
(2) the $H_2$ is fed to the furnace at a rate of from about 0.00075 to about 0.0015 lbm per second, and most preferably at about 0.001 lbm per second; and
(3) after addition of the $H_2$ is complete the system is maintained at temperature and allowed to soak for a period of from about 10 to about 5 hours, and most preferably about 12 hours.

It is particularly noted that in the present process, the sponge is only partially hydrided. Most processes allow the metal or sponge to absorb as much hydrogen as it possibly can prior to crushing. In the present process, the "as-reduced" sponge requires only between about 0.2% and 0.4% hydrogen by weight to achieve the desired results. Zirconium sponge is capable of absorbing much more hydrogen. Furthermore, the method of hydrogen introduction as described in detail below is important. A slow, very carefully controlled flow of hydrogen into the furnace is desirable for safety reasons and product quality. The small particles of zirconium sponge produced in this manner maintain much of the porosity and irregular shape of large chunks of as-reduced sponge. Compacted parts produced from these particles hold together better than parts made from normally crushed sponge due to the better mechanical interlocking afforded by these characteristics. Normally crushed sponge particles are more regularly shaped and have smooth surfaces due to the plastic deformation mentioned above.

In regard to the controlled $H_2$ feed, the $H_2$ feed lines and fittings and thus the possibility of leakage are reduced to a minimum. The hydrogen is introduced into the furnace through a "choked-flow" orifice which comprises a dimensioned aperture drilled through a plug. The principles of fluid mechanics indicate that only a certain amount of hydrogen is able to flow through this orifice, depending on the temperature and pressure of the hydrogen itself. By measuring these variables, an accurate amount of hydrogen may be introduced into the furnace. In this way, the flow of hydrogen is safely restricted and measured without additional hardware beyond pressure and temperature gauges.

The following general example will further illustrate the present process:

Up to eight 55 gallon drums of "as-reduced" zirconium sponge are loaded onto supporting racks in an electrically heated vacuum furnace. Each drum may contain up to 2300 pounds of zirconium in particle sizes varying from about 20 mesh up to 6" or more. No lids are placed on the drums. Large baskets or trays may be used in place of drums. The furnace used is cylindrical, about 5 feet in diameter and about 14 feet tall, and is capable of maintaining temperatures of 1000+ C., with vacuum levels on the order of 1 micron. Various pipelines are connected to the furnace body so that different gases may be added when desired. These gases include hydrogen, argon and air.

After the furnace is loaded and sealed, the vacuum pumping system is started and is opened until the pressure within the furnace is less than 100 microns. At this point, the furnace heat is turned on and set to a maximum of 200° C. The furnace is maintained at this temperature for 48 hours, with the vacuum pumping system operating the entire time to ensure that all residual moisture which may be present is removed. At the end of 48 hours, the temperature of the furnace is increased by 100 degrees per hour until a temperature of 725° C. is achieved. At this time, the vacuum pumping system is isolated from the furnace by means of a vacuum shut off valve. The pressure within the furnace is monitored for 15 minutes. If, after this period, the pressure exceeds 100 microns, a leak is assumed to exist and further operations are halted. Normally, however, the pressure remains on the order of 5 to 10 microns.

A valve is then opened to supply hydrogen gas to the furnace. This is a standard 1", ¼ turn ball valve, but most any valve design would do. Downstream from this valve is a short section of 1" pipe with a plug welded in its bore. A 1/16" diameter hole is drilled through this plug through which all of the hydrogen must pass. Upstream from the ball valve are located a pressure gauge and thermometer which measure the pressure and temperature of the hydrogen gas. The time is noted when the ball valve is opened. Several minutes are allowed for the flow to stabilize, then the pressure and temperature of the hydrogen are noted.

The principles of fluid mechanics, in particular the condition known as "choked-flow", indicate that only a limited amount of hydrogen may flow through the 1/16" diameter hole, and this amount is based on the pressure and temperature upstream from the hole. For hydrogen gas flowing through a 1/16" diameter hole, the mass flow rate is given by the equation:

$$\textit{mass flow rate} = 0.000003 \times (\textit{pressure}/\textit{sqr}(\textit{temperature})),$$

where the units of mass flow are lbm/sec, the units of pressure are lbf/square foot (absolute), and the units of temperature are degrees Rankine.

The desired or predetermined amount of hydrogen to be added to the zirconium sponge is approximately 0.29% by weight, though the range between 0.2% and 0.4% by weight is suitable. Knowing the number of pounds of zirconium sponge that are contained in the furnace, and knowing the choked-flow and mass flow rate, one can then calculate how many seconds to leave the ball valve open in order to introduce the desired number of pounds of hydrogen into the furnace.

For a load of 10,000 pounds, for example, 29 pounds of hydrogen must be absorbed. If the temperature of the hydrogen is 60° F. (520° Rankine), and the pressure is 40 psig (54.7 psia, or 7,876.8 psf), the mass flow rate is 0.00 lbm/sec. Dividing 29 pounds by this flow rate indicates that the valve must be left open for 27,985 seconds, or about 7¾ hours.

If, in practice, the pressure and temperature of the hydrogen remain relatively constant from day to day, the calculation need not be made in each instance; rather, a chart may be printed which indicates how long to leave the valve open for a given weight of zirconium sponge.

When the addition of hydrogen is complete, the ball valve is closed. Typically, the pressure in the furnace will be several Torr at the completion of hydrogen addition. The furnace temperature is kept at 725° C. for a 12 hour soaking period after hydrogen addition is complete. This soaking period allows the hydrogen to diffuse uniformly throughout the zirconium sponge. The vacuum pumping system remains isolated from the furnace throughout these latter process steps.

After this soak period, the heat to the furnace is turned off, and the furnace is allowed to cool for 36 hours. Air is then introduced into the furnace at a slow rate, so that it takes up to one hour for the pressure to build up to one atmosphere. The air supply valve is closed, and the vacuum pumping system is employed to pump the air out to a vacuum level of about 29" of mercury. When this vacuum level is reached, the vacuum pumping system is again isolated, and air is again introduced into the furnace. This procedure is referred to as "conditioning" and allows the zirconium to react slowly with air, pacifying the sponge. After the second conditioning cycle, the zirconium sponge is removed from the furnace.

Upon removal from the furnace, the zirconium sponge is crushed down to the desired particle size range. The particular crushing system used uses a toothed roll crusher to produce particles of a size typically smaller than ⅜. This crusher is manufactured by Willamette Industries of Portland, Ore. Oversize material is screened out by a vibrating screen (Sweco) and returned to the crusher. Material which is smaller than ⅜ is then further reduced by an attrition mill (Young Industries) to the desired size range. This size range may be, for example, the range −8 mesh +20 mesh, or −20 mesh +40 mesh. Again, oversize material is screened out and returned to the mill by a vibrating screen. A variety of other crushing methods would also work, in particular the use of jaw crushers, hammermills, and rotary shears.

After the zirconium sponge has been crushed and screened to the desired particle size range, it is loaded into baskets and returned to the furnace. The baskets are about 54" diameter and 12" deep. The baskets of crushed and screened zirconium sponge are heated in the vacuum furnace to a temperature of 1000 C. The vacuum pumping system runs continuously during this period. At this temperature, the hydrogen which was present in the zirconium sponge outgases from the sponge and is pumped out of the furnace. The furnace is run at this temperature until the vacuum level reaches 100 microns or less. The previously hydrided zirconium sponge thus treated contains less than 50 ppm of hydrogen after this treatment. The furnace is cooled and conditioned as described above. The zirconium sponge is then delumped through a delumper manufactured by Jersey Stainless and screened one more time across a vibrating screen. The zirconium sponge particles thus produced are suitable for compaction in a metal powder compacting press such as manufactured by Stokes, Inc.

The present invention has been described according to its presently preferred embodiment. Alterations in the process and subsequent use of the resultant materials is, of course, possible. The scope of the inventive concept is, therefore, intended to be limited only by the scope of the appended claims interpreted in view of the pertinent prior art.

I claim:

1. The process for producing crushed zirconium sponge having particle configurations which enhance its compactability, comprising the steps of:

(a) loading as-reduced, non-sintered zirconium sponge pieces into a vacuum furnace;

(b) heating said sponge under partial vacuum at a temperature of up to about 400° C. for a sufficient period to essentially demoisturize and degas the sponge;

(c) raising the temperature to between about 700° C. and 750° C. and terminating the vacuum;

(d) feeding $H_2$ slowly into the furnace over a predetermined period of time in a total amount of from about 0.05 to about 0.8% by weight of the sponge;

(e) cooling the furnace;

(f) pacifying the cooled sponge;

(g) removing the cooled sponge from the furnace and crushing it;

(h) loading the crushed sponge into a vacuum furnace;

(i) heating the crushed sponge at from about 950° C. to about 1100° C. under partial vacuum for a sufficient period to dehydride the crushed sponge; and (j) cooling and recovering the dehydrided crushed sponge, which is now capable of exhibiting enhanced compactability.

2. The process of claim 1 wherein the $H_2$ fed in step (d) is metered to the furnace and comprises from about 0.2 to about 0.4 by weight of the sponge.

3. The process of claim 1 wherein the $H_2$ is fed to the furnace at the rate of from about 0.00075 to about 0.0015 lbm per second.

4. The process of claim 3 wherein after addition of the $H_2$ is complete, the system is maintained at temperature and allowed to soak for a period of from about 10 to about 15 hours.

5. The process of claim 4 wherein the cooled and dehydrided sponge from step (i) is pacified.

6. The process of claim 1 wherein the $H_2$ is fed to the furnace through a choked-flow orifice.

* * * * *